US006672191B2

(12) United States Patent
Lin

(10) Patent No.: US 6,672,191 B2
(45) Date of Patent: Jan. 6, 2004

(54) PAPER TRIMMER HAVING MULTIPLE TRIMMER DEVICES

(76) Inventor: Chien-Fu Lin, No. 22, Nong 214, Fu Shang Lane, Si Tun Dist., Taichung City (TW)

( * ) Notice: Subject to any disclaimer, the term of this patent is extended or adjusted under 35 U.S.C. 154(b) by 273 days.

(21) Appl. No.: 09/928,216

(22) Filed: Aug. 13, 2001

(65) Prior Publication Data

US 2003/0029291 A1 Feb. 13, 2003

(51) Int. Cl.[7] ..... B26D 5/08
(52) U.S. Cl. ..... 83/549; 83/620; 83/627
(58) Field of Search ..... 83/618, 620, 598, 83/599, 601, 583, 584, 588, 589, 549, 552, 571, 627, 635; 30/278, 279.2, 314, 315, 358, 364

(56) References Cited

U.S. PATENT DOCUMENTS 440,835 A * 11/1890 Wickman ..... 83/552
629,824 A * 8/1899 Southworth ..... 83/588
1,375,721 A * 4/1921 Nichols ..... 83/552
3,516,317 A * 6/1970 Sundquist et al. ..... 83/620
3,656,387 A * 4/1972 Wark ..... 83/588
4,539,880 A * 9/1985 Barber et al. ..... 83/620
4,771,669 A * 9/1988 Bianchi ..... 83/618
4,929,276 A * 5/1990 Chun et al. ..... 83/618
5,211,095 A * 5/1993 Chun et al. ..... 83/618
5,495,671 A * 3/1996 Shun-Yi ..... 30/364
5,893,313 A * 4/1999 Mori ..... 83/583
6,016,733 A * 1/2000 Lin ..... 83/589

* cited by examiner

*Primary Examiner*—Stephen Choi
(74) *Attorney, Agent, or Firm*—Charles E. Baxley

(57) ABSTRACT

A paper trimmer includes a base having a plurality of trimmer devices connected thereto and a top member is mounted on the base and has a center hole through which a tube extending from the base extends. The top member has multiple extensions which is fixed on the base and the trimmer devices are located between the extensions. A pushing handle is rotatably mounted to the tube and has a tongue extending therefrom which is located above one of the trimmer devices. The chosen trimmer device can be operated by pushing the pushing handle.

7 Claims, 8 Drawing Sheets

PAPER TRIMMER HAVING MULTIPLE TRIMMER DEVICES

FIELD OF THE INVENTION

The present invention relates to a paper trimmer that has four sets of trimmer devices and a pushing handle is rotatable to operate one of the four trimmer devices.

BACKGROUND OF THE INVENTION

A conventional trimmer is shown in FIG. 8 and generally includes a base 13 with a handle 12 pivotally connected thereto and a fixed blade 11 is connected on the base 13 and a movable blade 10 is connected to an underside of the handle 12. The movable blade 10 is moved toward the fixed blade 11 by pushing the handle 12 so that a corner of a sheet of paper can be trimmed by the trimmer. However, the shape of the fixed blade 11 and the movable blade 10 is not changeable so that only one type of cutting can be used. If the users want to trim the paper with different variety of shapes, many trimmers have to be purchased.

The present invention provides a trimmer that has four different shapes of trimmer devices and a pushing handle can be rotated to operate any one of the trimmer device so that the users may conveniently choose a proper trimmer device.

SUMMARY OF THE INVENTION

In accordance with one aspect of the present invention, there is provided a paper trimmer which comprises a base having a tube extending from a top surface thereof and a plurality of trimmer devices are connected to the base and located around the tube. A top member has a center hole through which the tube extends. The top member has multiple extensions which are fixed on the base and the trimmer devices are located between the extensions. A pushing handle is rotatably mounted to the tube and a tongue extends from the pushing handle and is located above one of the trimmer devices.

The primary object of the present invention is to provide a trimmer that the users can choose desired type of trimmer device in the trimmer to cut the paper.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
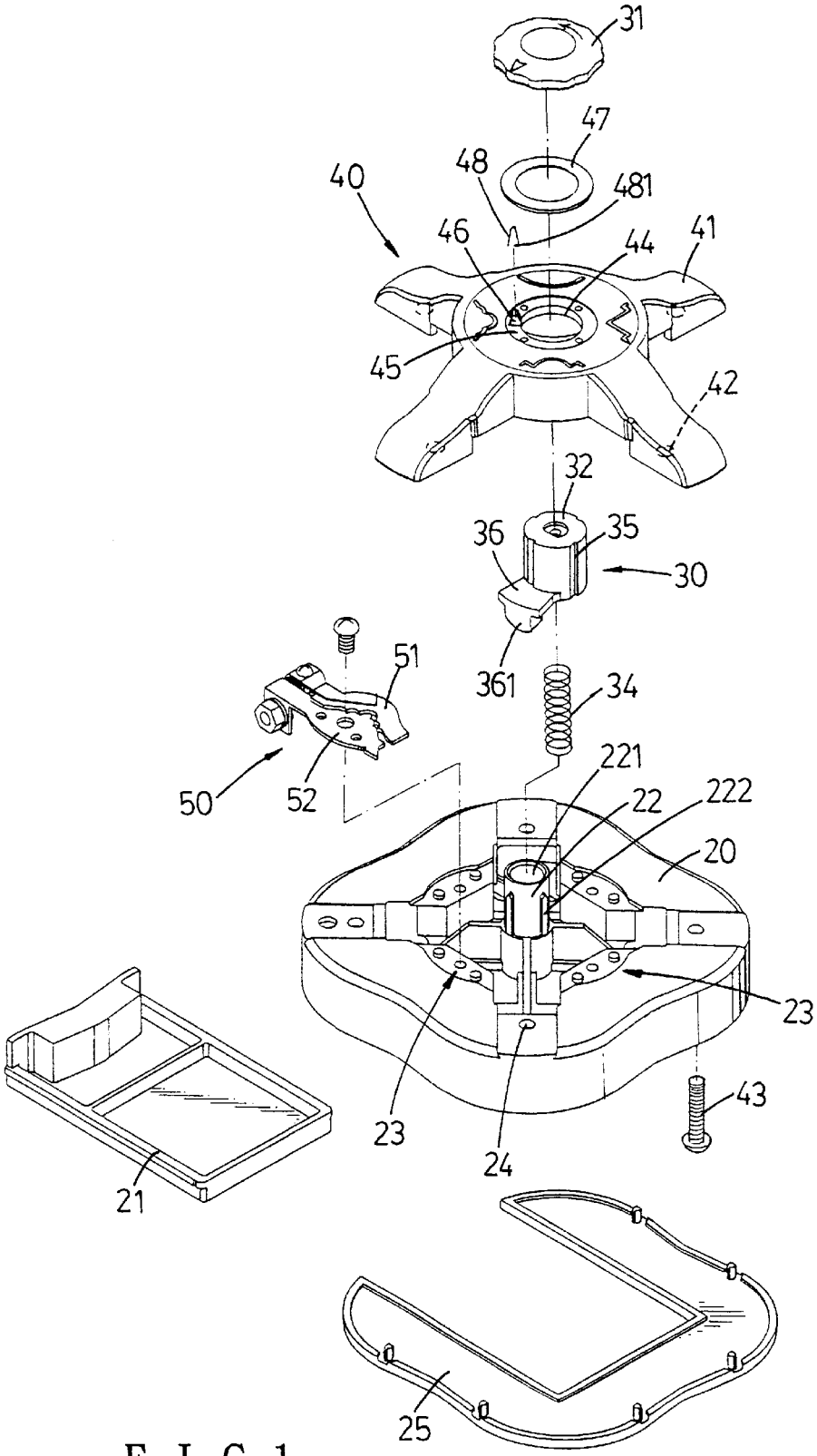
FIG. 1 is an exploded view to show the trimmer of the present invention.
Figure 2:
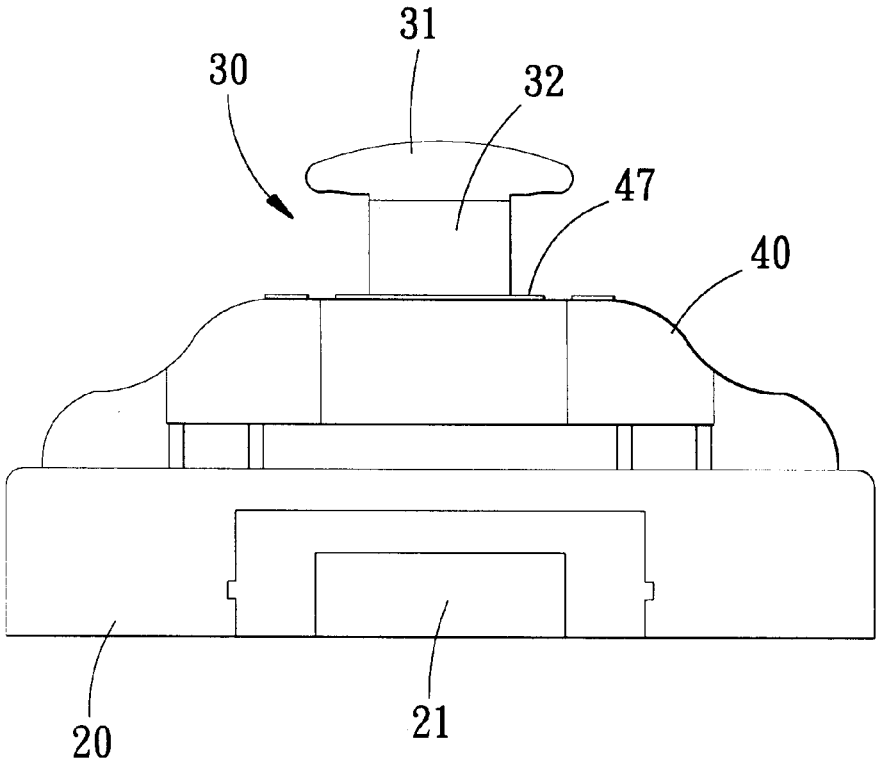
FIG. 2 is a side view to show the trimmer of the present invention.
Figure 3:
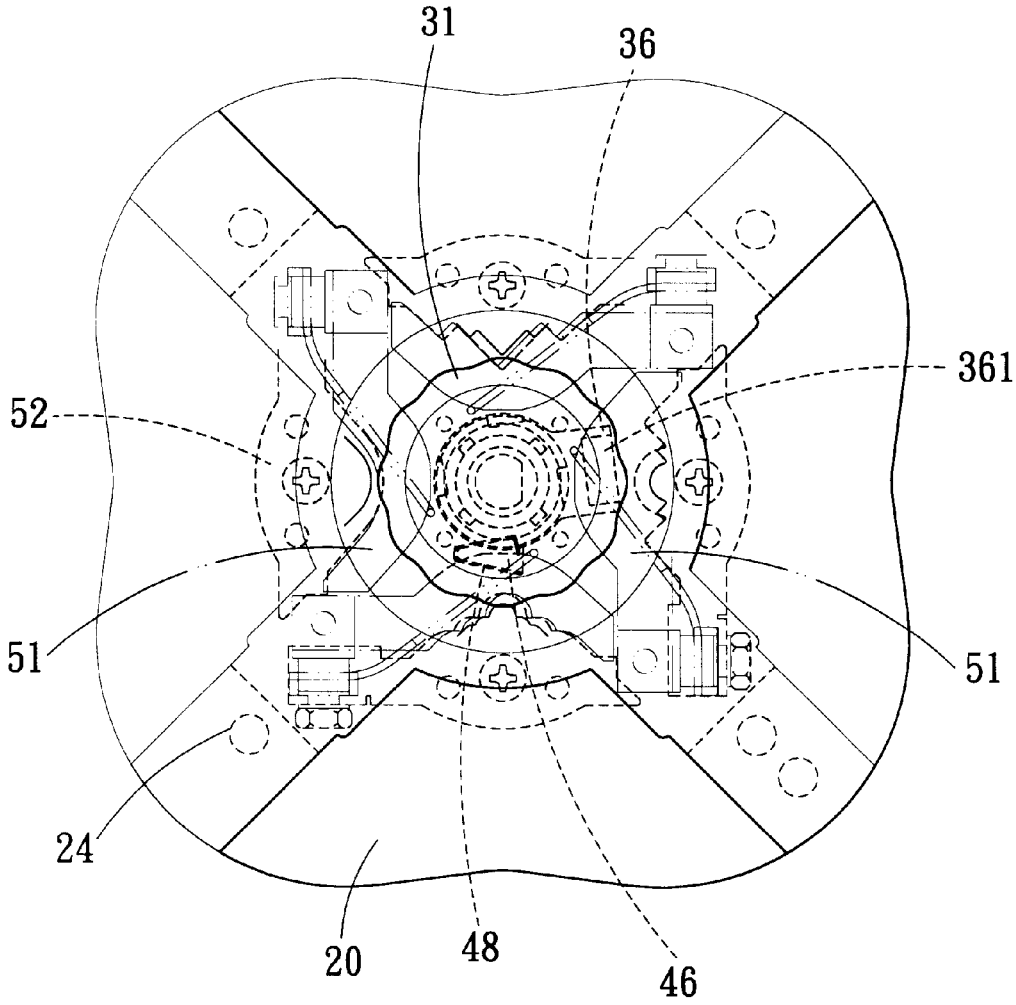
FIG. 3 is a top illustrative view to show the trimmer of the present invention.

Referring to FIGS. 1 to 3, the paper trimmer of the present invention comprises a base 20 having a tube 22 extending from a top surface thereof and the tube 22 has an open top 221. A plurality of ribs 222 extend from an outer periphery of the tube 22 and the ribs 222 are ended at a distance from the open top 221 of the tube 22. Four trimmer devices 50 are connected to the base plate 23 on the base 20 and located round the tube 22. Each trimmer device 50 has two blades 51, 52 and the blade 51 extrudes above the top surface of the base 20. A drawer 21 is received in the base 20 and a bottom cap 25 is removably engaged with a bottom of the base 20 so that it is convenient for the users to clean the debris of the paper.

A top member 40 has a center hole 44 through which the tube 22 extends. The top member 40 has four extensions 41 which is fixed on the base 20 by extending bolts 43 through holes 24 in the base 20 and engaged with the threaded holes 42 in the extensions 41. The trimmer devices 50 are located between the extensions 41.

Figure 5:
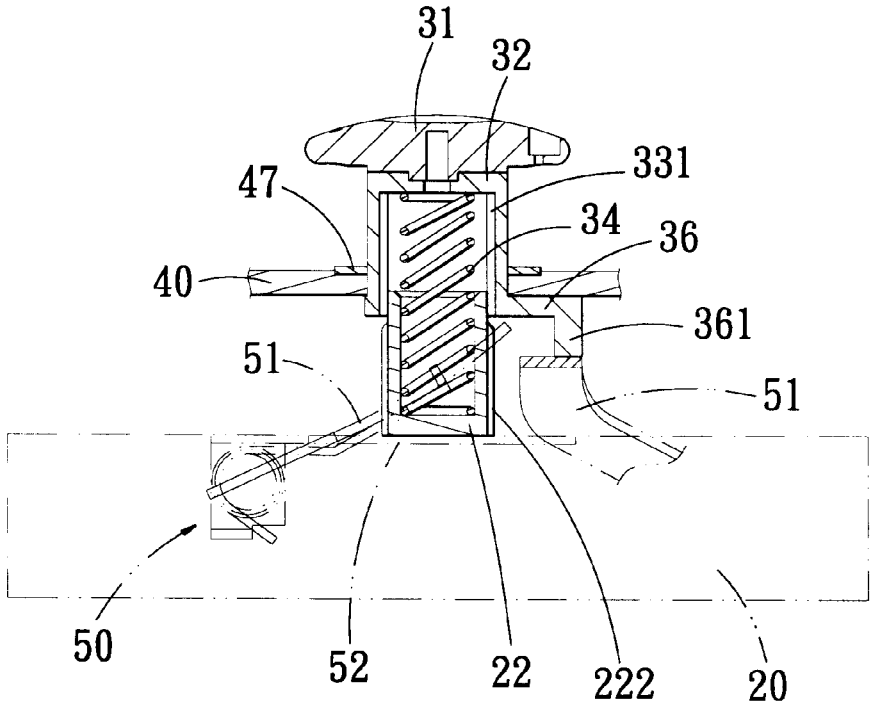
FIG. 5 is a cross sectional view to show the pushing handle of the trimmer of the present invention.
Figure 7:
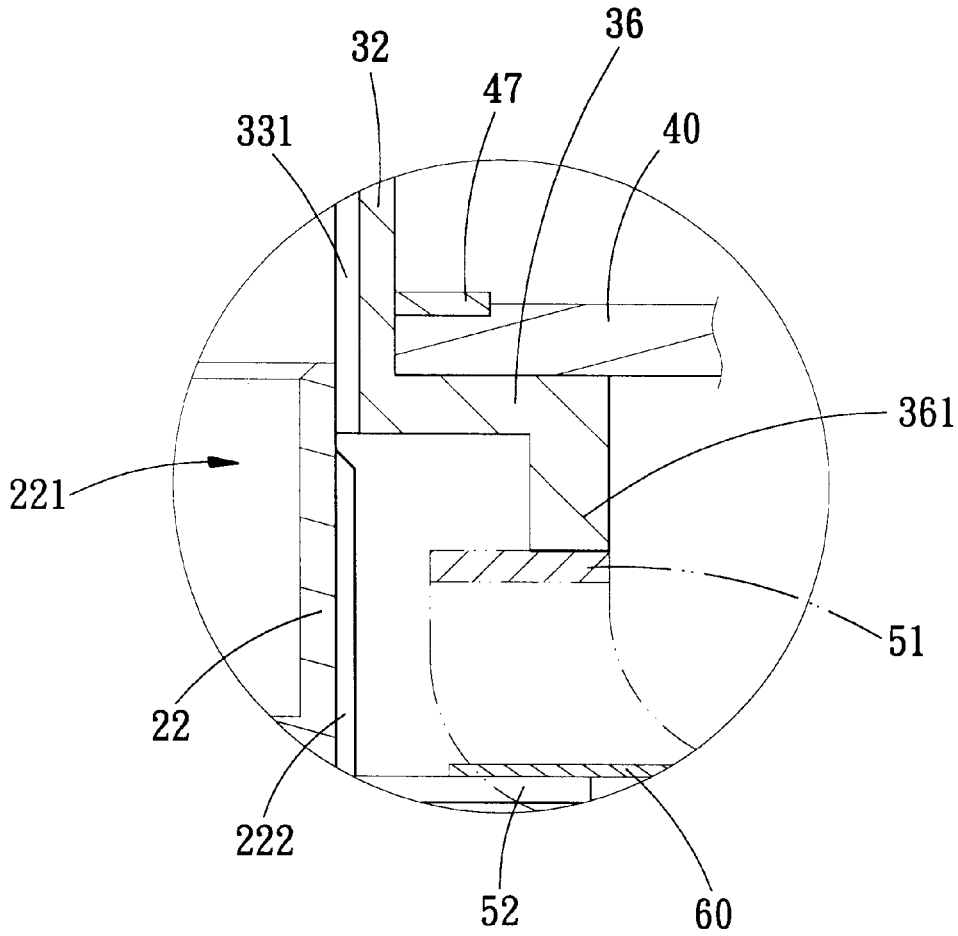
FIG. 7 is an enlarged cross sectional view to show the tongue of the pushing handle contacting the trimmer device.
Figure 8:
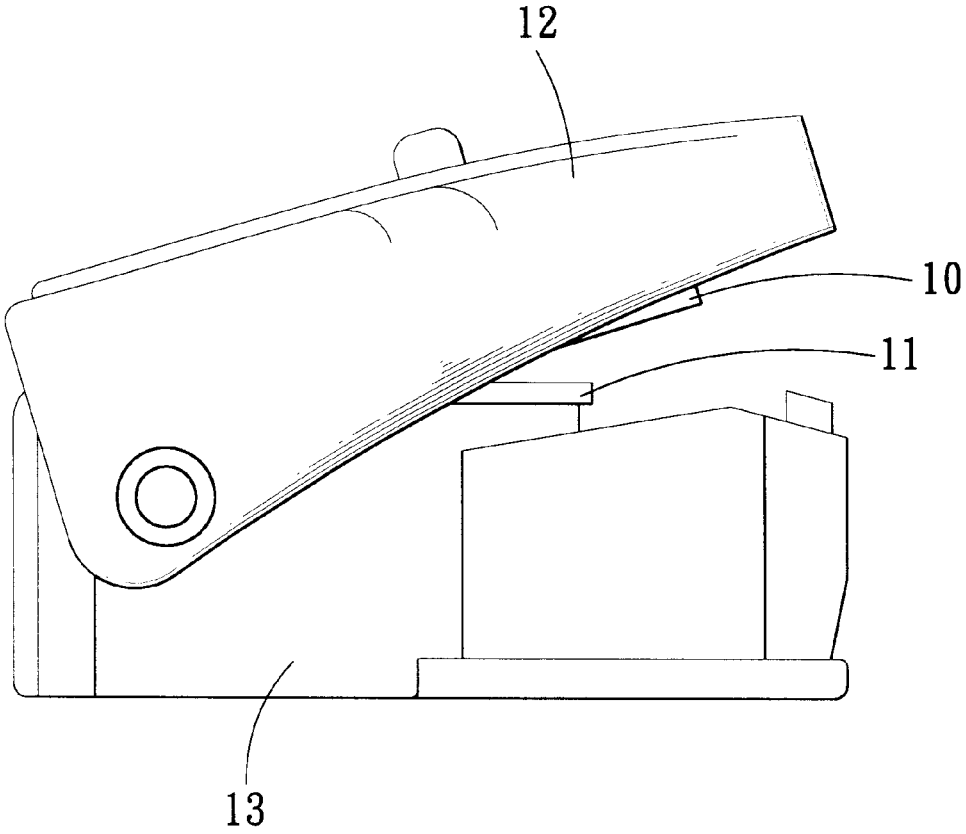
F I G. 8 PRIOR ART
FIG. 8 is a side view to show a conventional trimmer.

A tubular pushing handle 32 is rotatably mounted to the tube 22 and a plate 36 extends radially outward from the pushing handle 32. A tongue 361 extends from the plate 36 and is located above one of the trimmer devices 50 as shown in FIGS. 5 and 7. A knob 31 is connected to a top of the pushing handle 32 so that the users may hold and push the knob 31. The pushing handle 32 has grooves 331 defined in an inner periphery thereof so that the pushing handle 32 can be moved along the tube 22 with the ribs 222 being received in the grooves 331. A spring 34 is received in the open top 221 of the tube 22 and biased between the tube 22 and the pushing handle 32 so that the pushing handle 32 will bounce up after being pushed. An annular recess 45 is defined in a top surface of the top member 40 and a notch 46 is defined in an inside of the annular recess 45. A resilient member 48 is engaged with the notch 46 and has an protrusion 481 extending from the resilient member 48. A ring 47 is engaged with the annular recess 45 so as to position the resilient member 48 in the notch 46. The pushing handle 32 has four notches 35 defined in an outer periphery thereof so that the protrusion 481 is engaged with one of the notches 35. When the protrusion 481 is engaged with one of the notches 35, the users know the tongue 361 is located at correct position.

Figure 4:
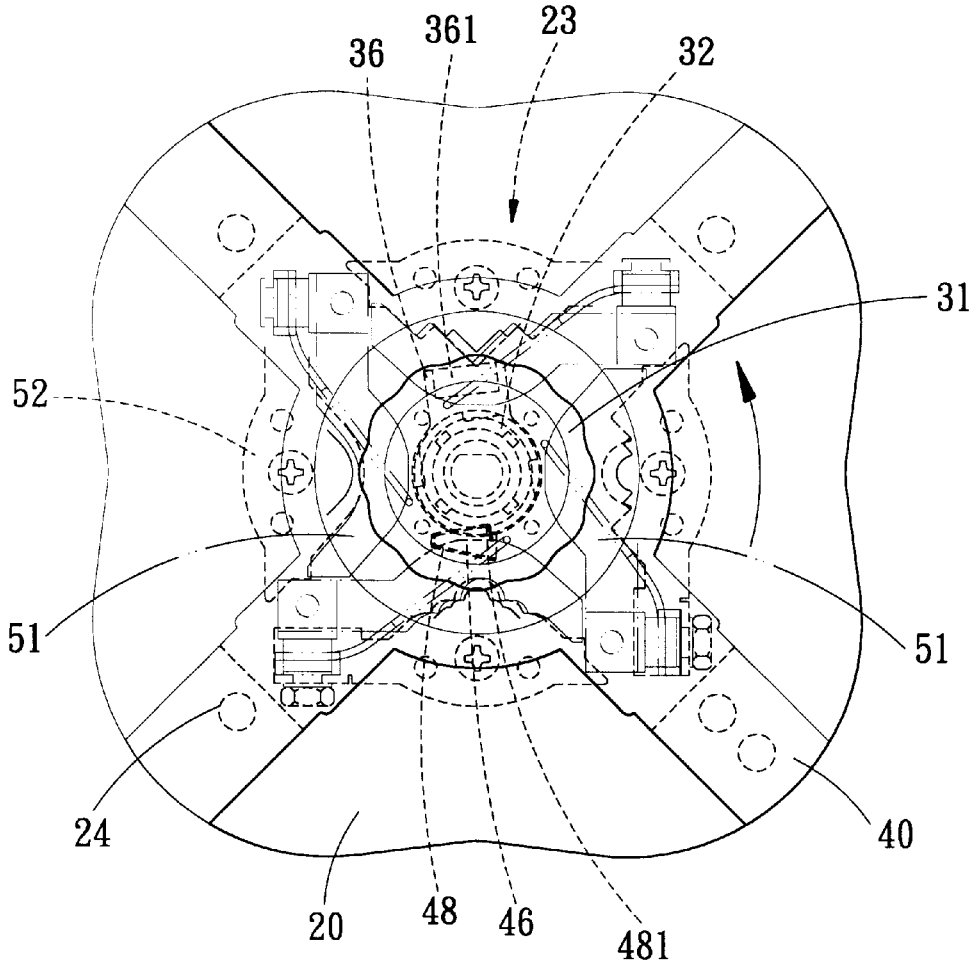
FIG. 4 is a top illustrative view to show the pushing handle of the trimmer of the present invention is rotated.
Figure 6:
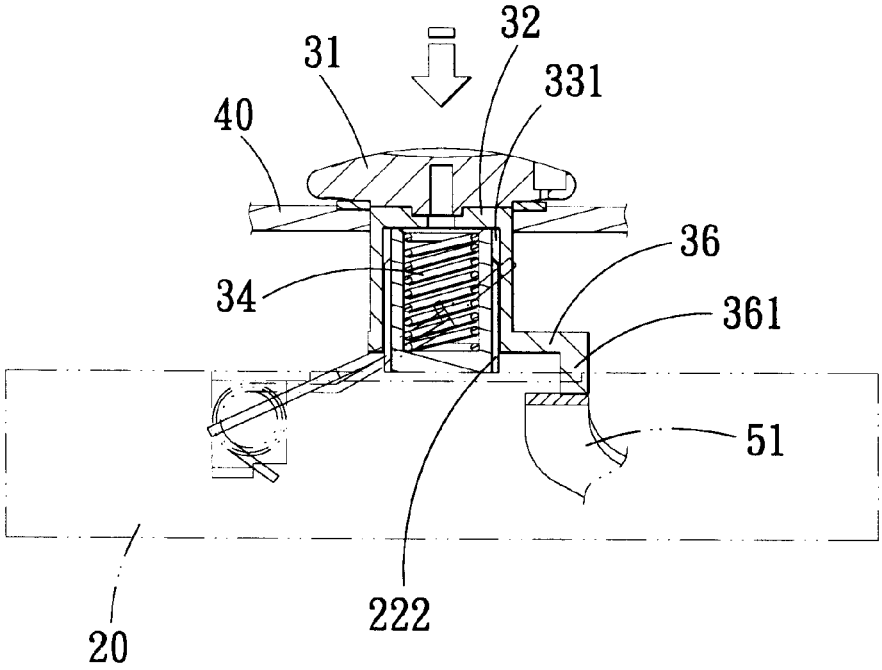
FIG. 6 is a cross sectional view to show that the pushing handle of the trimmer of the present invention is pushed.

As shown in FIGS. 4 and 6, when the pushing handle 30 is not pushed, it is able to be rotated on the tube 22 because the grooves 331 are not engaged with the ribs 222 so that the tongue 361 can be moved to a desired position. A sheet of paper 60 as shown in FIG. 7 can be guided by two sides of the sheet contacting two inner sides of any two adjacent extensions 41 so that one corner of the sheet is inserted between the two blades 51, 52 of the chosen trimmer device 50. When the trimmer device 50 is chosen, the tongue 361 is shifted to the chosen trimmer device 50 and then the pushing handle 30 is pushed so that the blade 51 is pushed toward the other blade 52 to cut or trim the sheet paper 60.

While we have shown and described the embodiment in accordance with the present invention, it should be clear to those skilled in the art that further embodiments may be made without departing from the scope of the present invention.

What is claimed is:

1. A paper trimmer comprising:

a base having a tube extending from a top surface thereof, a plurality of trimmer devices connected to said base and located around said tube, each trimmer device having two blades;

a top member having a center hole through which said tube extends, said top member having multiple extensions which are fixed on said base, each respective trimmer device being located between respective two of said extensions such that a corner of said paper is guided and positioned between said two of said extensions, and a pushing handle rotatably mounted to said tube and a tongue extending from said pushing handle, said tongue being selectively rotatable such that said tongue is located above one of said trimmer devices to be pressed on said one of trimmer devices by said pushing handle to trim the corner of the paper.

2. The trimmer as claimed in claim 1 further comprising ribs extending from an outer periphery of said tube and said ribs ended at a distance from a top end of said tube, said pushing handle having grooves defined in an inner periphery thereof so that said pushing handle is moved along said tube with said ribs being received in said grooves.

3. The trimmer as claimed in claim 2, wherein said tube has an open top and a spring is received in the open top and biased between said tube and said pushing handle.

4. The trimmer as claimed in claim 1 further comprising a resilient member engaged with said top surface of said base and a protrusion extending from said resilient member, said pushing handle having notches defined in an outer periphery thereof so that said protrusion is engaged with one of said notches.

5. The trimmer as claimed in claim 4 further comprising an annular recess defined in a top surface of said top member and a notch defined in an inside of said annular recess, said resilient member engaged with said notch and a ring engaged with said annular recess so as to position said resilient member in said notch.

6. The trimmer as claimed in claim 1 further comprising a drawer received in said base.

7. The trimmer as claimed in claim 1 further comprising a bottom cap removably engaged with a bottom of said base.

* * * * *